US007271548B2

(12) United States Patent
Hsueh et al.

(10) Patent No.: US 7,271,548 B2
(45) Date of Patent: Sep. 18, 2007

(54) MULTI-LAMP DRIVERS AND TRANSFORMERS THEREOF

(75) Inventors: Ching-Fu Hsueh, Taoyuan (TW); Cheng-Hsien Chien, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 11/340,985

(22) Filed: Jan. 27, 2006

(65) Prior Publication Data

US 2006/0175981 A1 Aug. 10, 2006

(30) Foreign Application Priority Data

Feb. 5, 2005 (TW) ..... 94103948 A

(51) Int. Cl.
*H05B 41/24* (2006.01)

(52) U.S. Cl. ..... 315/274

(58) Field of Classification Search ..... 315/70, 315/219, 224, 267, 268, 269–270, 274, 276, 315/278–279; 363/21.02, 21.07, 21.08, 21.15, 363/153, 171

See application file for complete search history.

(56) References Cited

U.S. PATENT DOCUMENTS 6,362,986 B1 * 3/2002 Schultz et al. ..... 363/132
6,388,896 B1 * 5/2002 Cuk ..... 363/16
6,515,875 B2 * 2/2003 Yasumura ..... 363/21.02
6,952,353 B2 * 10/2005 Yan et al. ..... 363/16
7,016,203 B2 * 3/2006 Xu et al. ..... 363/21.04

* cited by examiner

*Primary Examiner*—Shih-Chao Chen
*Assistant Examiner*—Minh Dieu A
(74) *Attorney, Agent, or Firm*—Ouintero Law Office

(57) ABSTRACT

A multi-lamp driver driving first and second lamps and comprising a driving circuit and a transformer. The transformer comprises a winding rack, a magnetic core, two primary winding sets, and two secondary winding sets. One portion of the magnetic core is inserted into the winding rack. The two primary winding sets are wound around the winding rack and receive low-voltage signals from the driving circuit. The two secondary winding sets are wound around the winding rack, and two high-voltage signals are induced to respectively drive the first and second lamps. The primary winding sets have substantially the same number of windings, and the secondary winding sets have substantially the same number of windings.

8 Claims, 8 Drawing Sheets

MULTI-LAMP DRIVERS AND TRANSFORMERS THEREOF

BACKGROUND OF THE INVENTION

1. Field of the Invention

The present invention relates to a multi-lamp driver, and in particular to a driver for discharging lamps to balance currents flowing through the lamps.

2. Description of the Related Art

Current display devices, such as liquid crystal display (LCD) devices, require lamps with high efficiency and light shape to serve as backlight units. Cold cathode fluorescent lamps (CCFLs) are usually used in LCD device. As the size of display devices increases, single lamp backlight units become inadequate. A backlight unit with a plurality of lamps, however, can provide enough brightness for a large display device.

FIG. 1 is one conventional multi-lamp driver. The driver comprises a driving circuit 11, a transformer 12, capacitors C1 and C2, a balance circuit 13, and lamps 151 and 152. The transformer 12 is composed of a primary winding set 121, a secondary winding set 122, and a magnetic core 123. The driving circuit 11 provides a low-voltage signal to the primary winding set 121 of the transformer 12, and the secondary winding set 122 thereof inducts a high-voltage signal to drive the lamps 151 and 152. Currents flowing through the lamps 151 and 152 are different due to resistance of wires or stray capacitance. The different currents result in non-uniform brightness of the lamps 151 and 152, reducing image quality. The balance circuit 13 is thus used to balance the different currents flowing through the lamps 151 and 152.

FIG. 2 is another conventional multi-lamp driver. To describe the driver of FIG. 2, the elements of the driver in FIG. 2 same as those of the driver in FIG. 1 are identified with the same reference numerals. A balance circuit 23 of the driver in FIG. 2 is coupled to a ground and between the lamps 151 and 152, different from the balance circuit 13 of the driver in FIG. 2.

FIG. 3 shows the configuration of the transformer 12. The primary winding set 121 and the secondary winding set 122 are respectively wound around two sides 311 and 312 of the magnetic core 123.

In the above drivers in FIGS. 1 and 2, the two winding sets of the transformer 12 are respectively used for a high-voltage side and a low-voltage side. When a plurality of lamps are driven, three methods, such as coupling the lamps in series, coupling the lamps in parallel, and using a plurality of transformers, must be used. The problems of withstand voltage of the transformer, however, is not solved easily although coupling the lamps in series can overcome the problem of different currents. A balance circuit is required for coupling the lamps in parallel. Moreover, a plurality of transformers occupy more space and cost more.

BRIEF SUMMARY OF THE INVENTION

An exemplary embodiment of a multi-lamp driver drives a first lamp and a second lamp and comprises a driving circuit and a transformer. The driving circuit provides a first voltage signal and a second voltage signal. The transformer comprises a winding rack, a magnetic core, a first primary winding set, a second primary winding set, a first secondary winding set, and a second secondary winding set. One portion of the magnetic core is inserted into the winding rack. The first primary winding set is wound around the winding rack and coupled to the first voltage signal. The second primary winding set is wound around the winding rack, disposed away from the first primary winding set at a predetermined distance d, and coupled to the second voltage signal. The first and second voltage signals are substantially equal. The first secondary winding set is wound around the winding rack and disposed between the first primary winding set and the second primary winding set and close to the first primary winding set. The first secondary winding set induces a third voltage signal to drive the first lamp. The second secondary winding set is wound around the winding rack and deposed between the first primary winding set and the second primary winding set and close to second primary winding set. The second secondary winding set induces a fourth voltage signal to drive the second lamp. The first primary winding set and the second primary winding set have substantially the same number of windings, and the first secondary winding set and the second secondary winding set have substantially the same number of windings.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
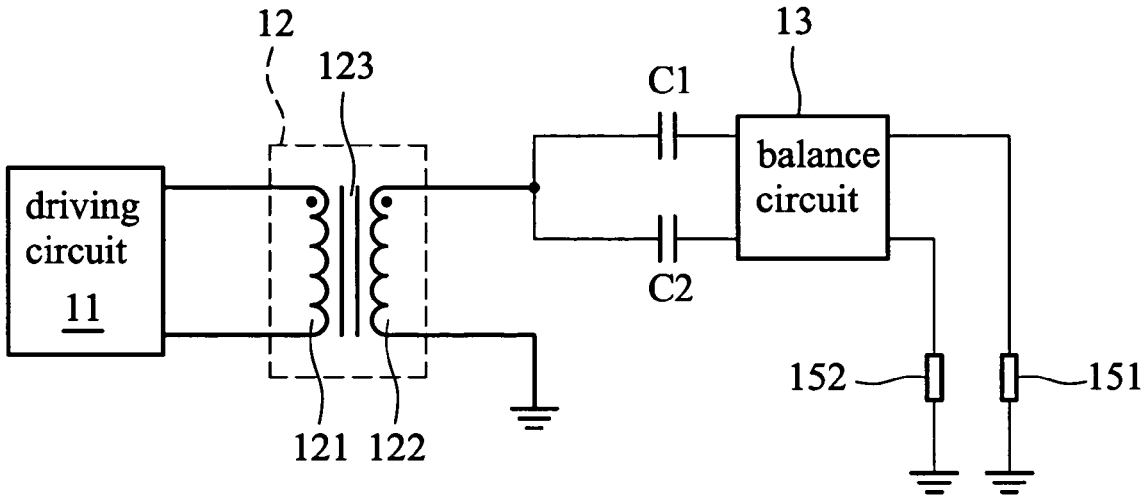
FIG. 1 ( RELATED ART )
FIG. 1 is one conventional multi-lamp driver.
Figure 2:
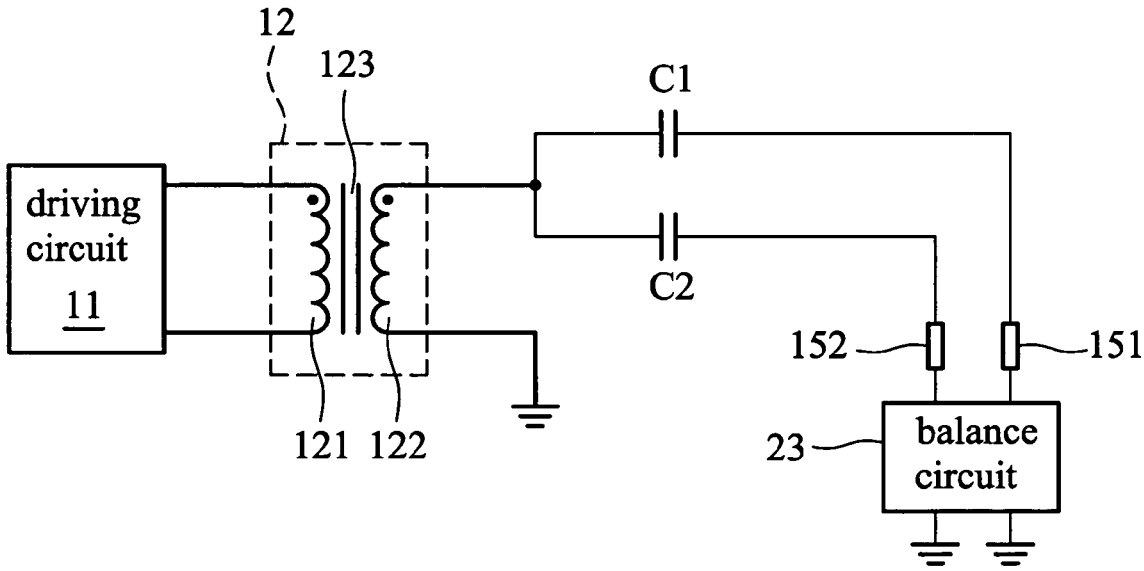
FIG. 2 ( RELATED ART )
FIG. 2 is another conventional multi-lamp driver.
Figure 3:
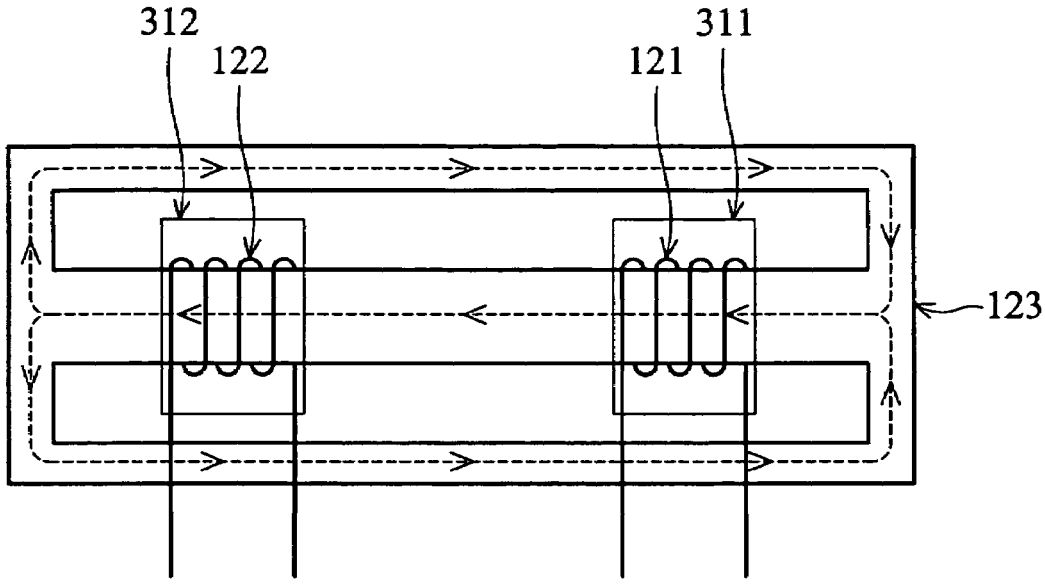
FIG. 3 ( RELATED ART )
FIG. 3 shows the configuration of a transformer of a conventional multi-lamp driver.

The following description is of the best-contemplated mode of carrying out the invention. This description is made for the purpose of illustrating the general principles of the invention and should not be taken in a limiting sense. The scope of the invention is best determined by reference to the appended claims.

Multi-lamp drivers are provided. In an exemplary embodiment of a multi-lamp driver in FIG. 4, a multi-lamp driver is used to drive a first lamp L1 and a second lamp L2 and comprises a driving circuit 41 and a transformer 42. The first and second lamps L1 and L2 can be discharging lamps, such as cold cathode fluorescent lamps.

The transformer 42 comprises a magnetic core 425, a first primary winding set 421, a second primary winding set 423, a first secondary winding set 422, and a second secondary winding set 424. The first primary winding set 421 and the second primary winding set 423 are coupled to the driving circuit 41 and respectively receive a first voltage (low voltage) signal V1 and a second voltage (low voltage) signal provided by the driving circuit 41. The first secondary winding set 422 and the second secondary winding set 424 respectively induct a third voltage (high voltage) signal V3 and a fourth voltage (high voltage) signal V4. The first lamp L1 is coupled to the first secondary winding set 422 and driven by the third voltage signal V3. The second lamp L2 is coupled to the second secondary winding set 424 and driven by the fourth voltage signal V4. The first voltage signal V1 is substantially equal to the second voltage signal V2, and the third voltage signal V3 is substantially equal to the fourth voltage signal V4. In this embodiment, the first and second lamps L1 and L2 are driven in-phase. That is, the first and second lamps L1 and L2 are respectively coupled to the terminals of the first secondary winding set 422 and the second secondary winding set 424 which have the same polarity, as shown by the symbol "•" in FIG. 4. In practice, the first and second lamps L1 and L2 can be driven by out-of-phase. The driving circuit 41 can be a full-bridge circuit.

A capacitor C1 is coupled between the first lamp L1 and the first secondary winding set 422, and a capacitor C2 is coupled between the second lamp L2 and the second secondary winding set 424. The first primary winding set 421 and the second primary winding set 423 have the same number of windings, and the first secondary winding set 422 and the second secondary winding set 424 have the same number of windings. Since the first secondary winding set 422 and the second secondary winding set 424 of the transformer 42 have the same magnetic flux, currents flowing through the lamps L1 and L2 can be automatically balanced.

Figure 4:
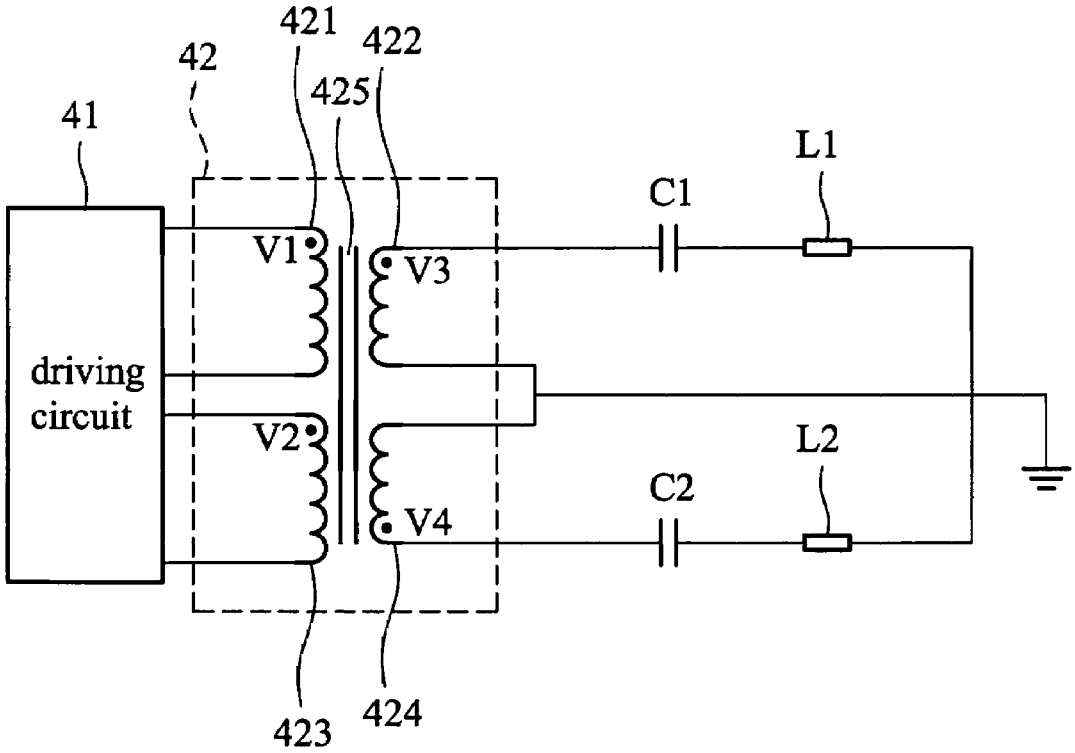
FIG. 4 depicts an embodiment of a multi-lamp driver.
Figure 5:
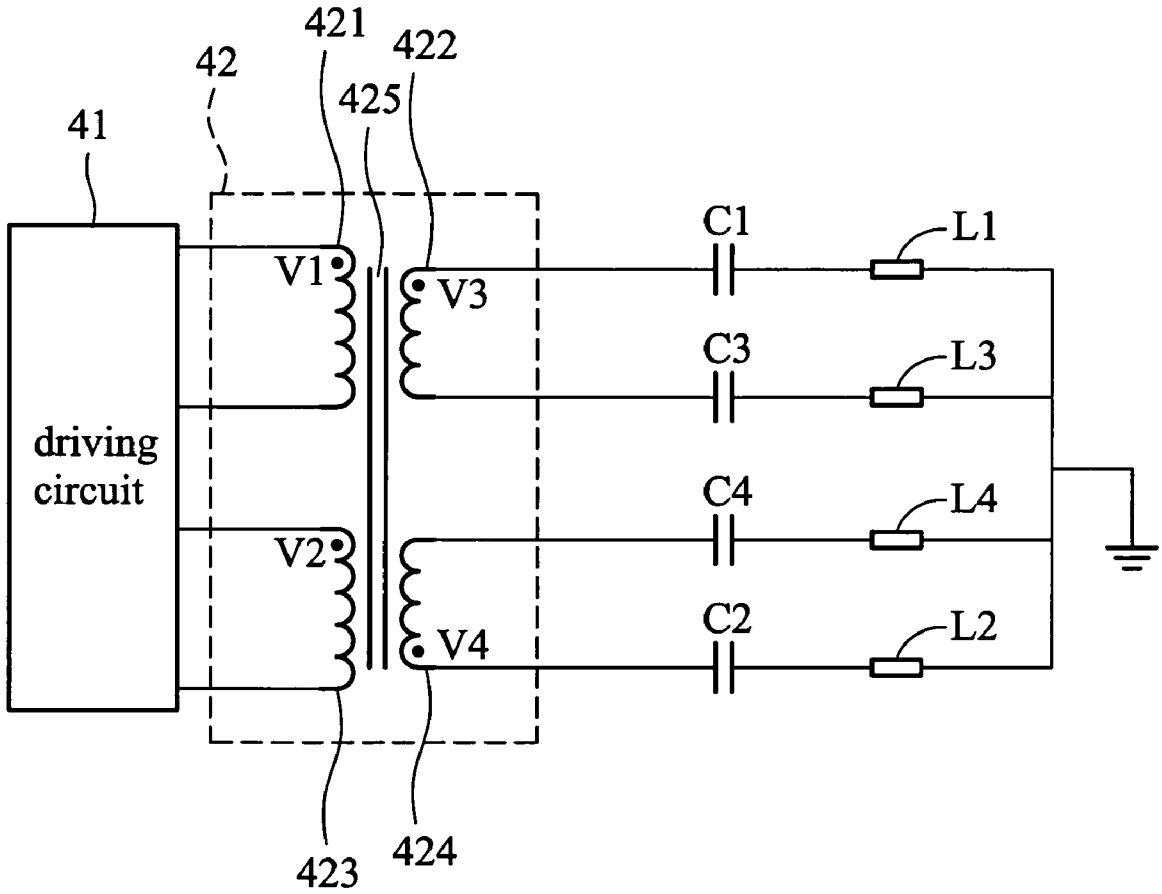
FIG. 5 depicts an embodiment of a multi-lamp driver.
Figure 6A:
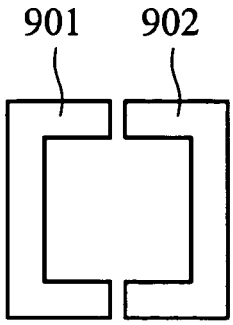
FIGS. 6*a*-6*k* show various shapes of a magnetic core in a multi-lamp driver.
Figure 6B:
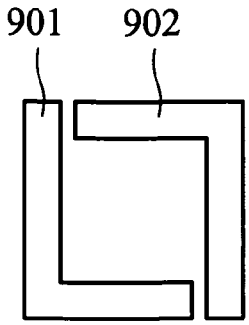
Figure 6C:
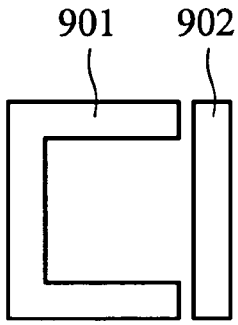
Figure 6D:
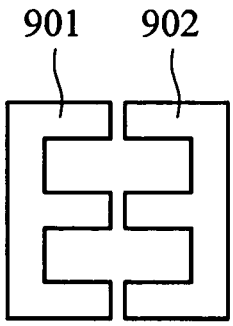
Figure 6E:
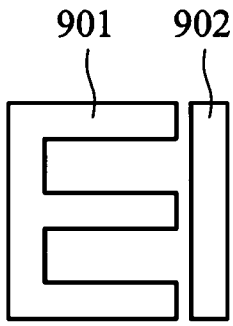
Figure 6F:
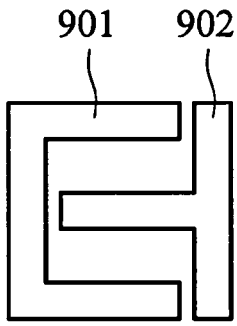
Figure 6G:
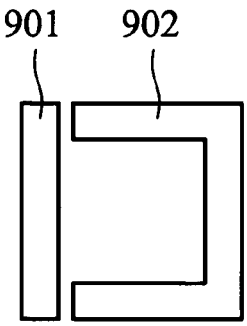
Figure 6H:
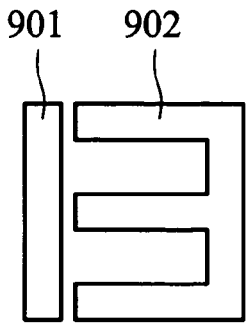
Figure 6I:
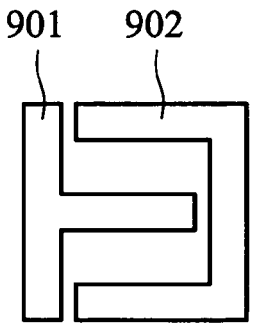
Figure 6J:
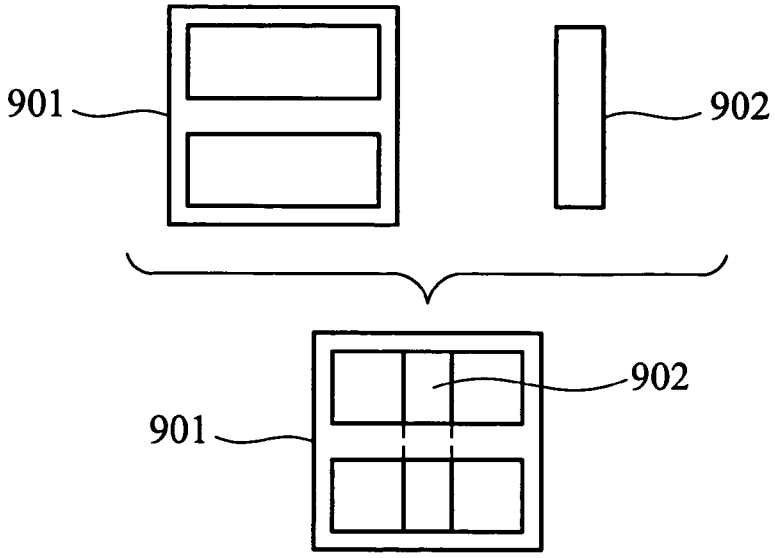
Figure 6K:
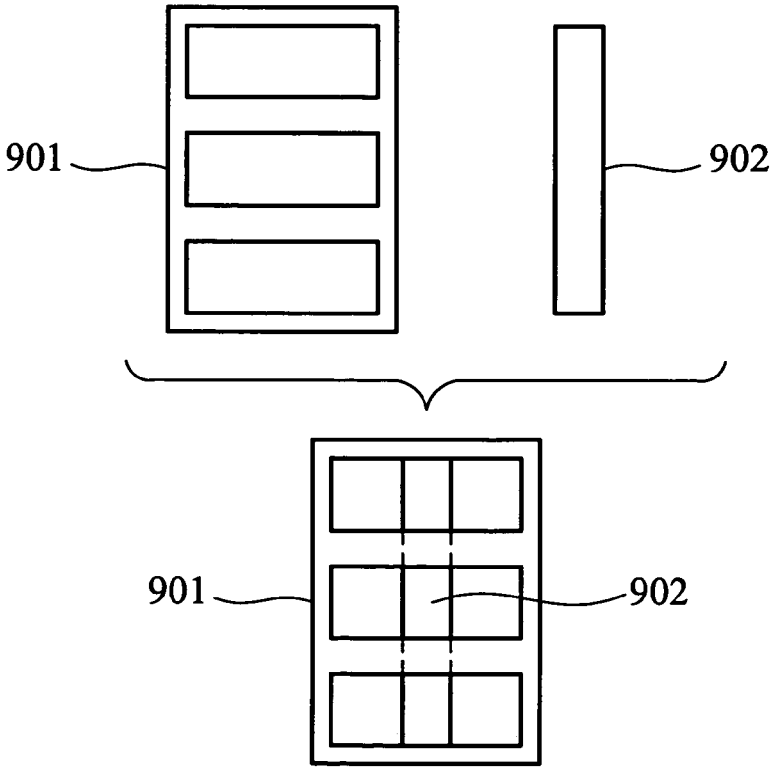

In an exemplary embodiment of a multi-lamp driver in FIG. 5, the difference between the drivers in FIGS. 4 and 5 is that each of the first secondary winding set 422 and the second secondary winding set 424 of FIG. 5 is coupled to two lamps, as a series coupling configuration. The driver in FIG. 5 further comprises a third lamp L3 and a fourth lamp L4. The lamps L1 and L3 are respectively coupled to two terminals of the first secondary winding set 422, and the lamps L2 and L4 are respectively coupled to two terminals of the second secondary winding set 424. The lamps L1 to L4 are commonly coupled to a ground. A capacitor C3 is coupled between the third lamp L3 and the first secondary winding set 422, and a capacitor C4 is coupled between the fourth lamp L4 and the second secondary winding set 424. The lamps L1 to L4 can be discharging lamps, such as cold cathode fluorescent lamps.

As shown in FIGS. 6*a* to 6*k*, the magnetic core 425 is composed of a first portion 901 and a second portion 902. The first portion 901 and the second portion 902 can be formed as shapes of one symbol set, such as "EE", "UU", "UI", "EI", "UT", "⊟ I", "⊟ I", and "LL", without limitation. According to the symbol sets of "⊟ I" and "⊟ I" of the magnetic core, the primary winding sets and the secondary winding sets are wound around a winding rack outside of the portion of shape "I", and the portion of shape ⊟ or ⊟ and the portion of shape "I" form a magnetic loop.

Figure 7:
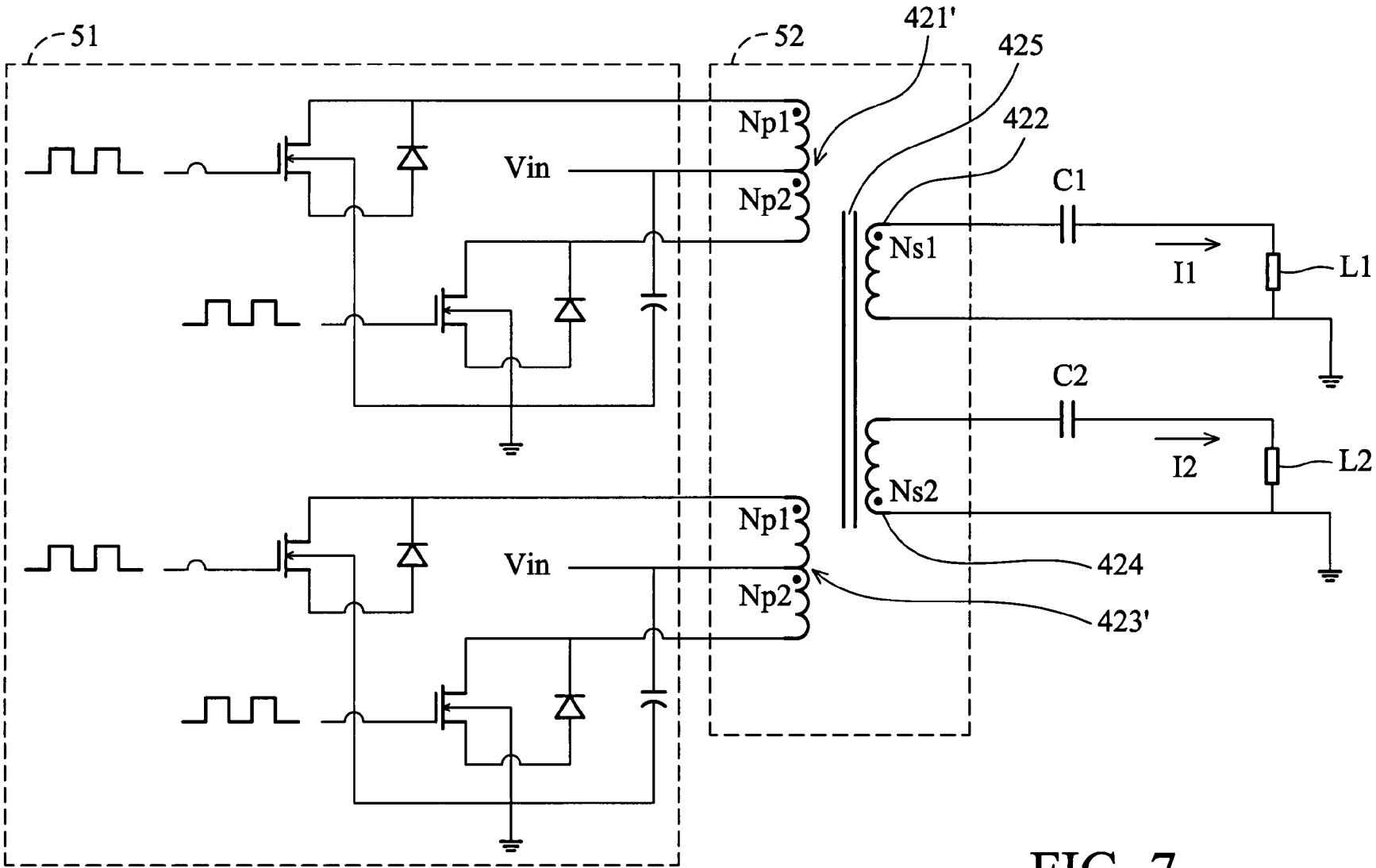
FIG. 7 depicts an embodiment of a multi-lamp driver.

The primary winding sets of the transformer can be composed of more than one winding for application to different driver configurations. In an exemplary embodiment of a multi-lamp driver in FIG. 7, the difference between the drivers in FIGS. 4 and 7 is that each of a first primary winding set 421' and a second secondary winding set 423' of a transformer 52 is composed of two windings Np1 and Np2 and coupled to a driving circuit 51. The driving circuit 51 can be a push-pull circuit or half-bridge circuit, without limitation.

Figure 8:
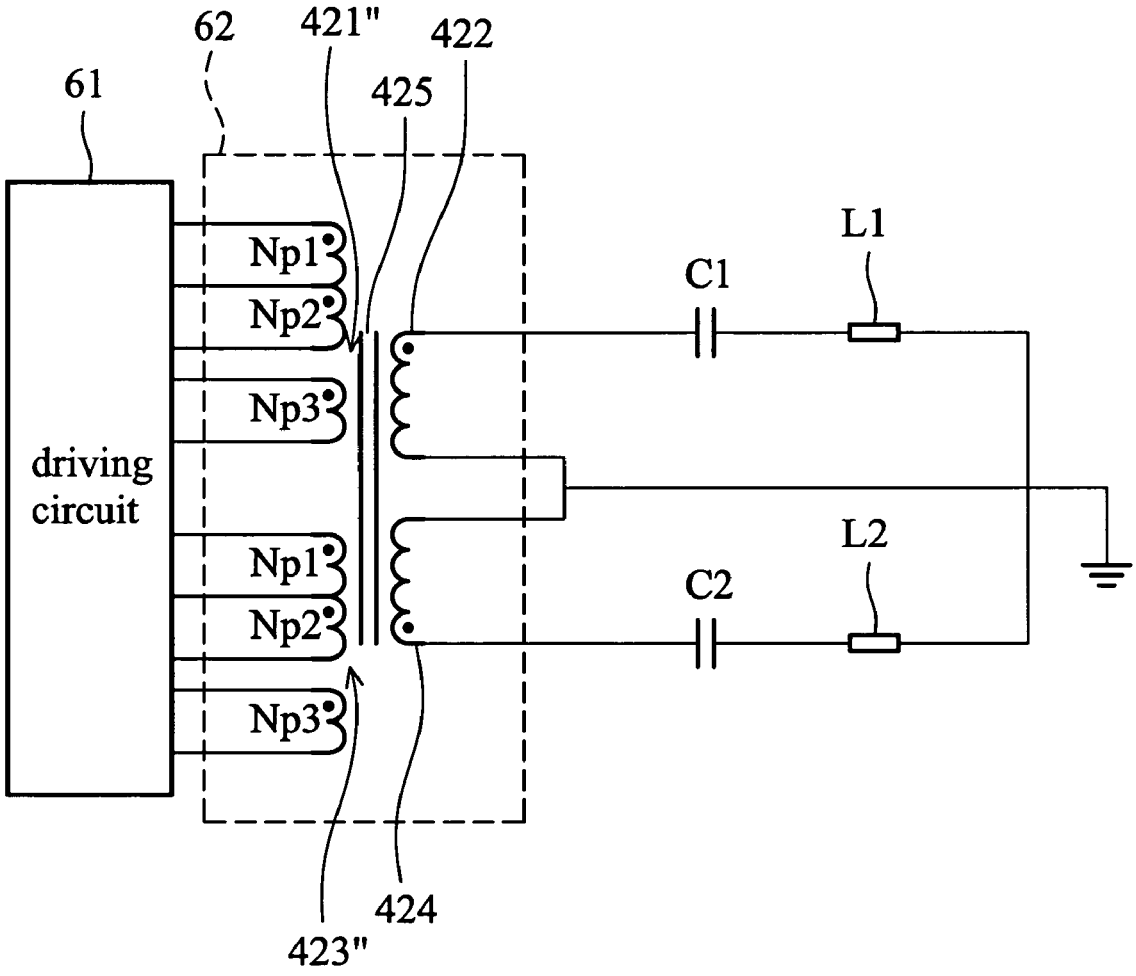
FIG. 8 depicts an embodiment of a multi-lamp driver.

In an exemplary embodiment of a multi-lamp driver in FIG. 8, the difference between the drivers in FIGS. 4 and 8 is that a first primary winding set 421" and a second secondary winding set 423" of a transformer 62 are composed of three windings Np1 to Np3 and coupled to a driving circuit 61. The driving circuit 61 can be a Royer circuit, without limitation.

Figure 9:
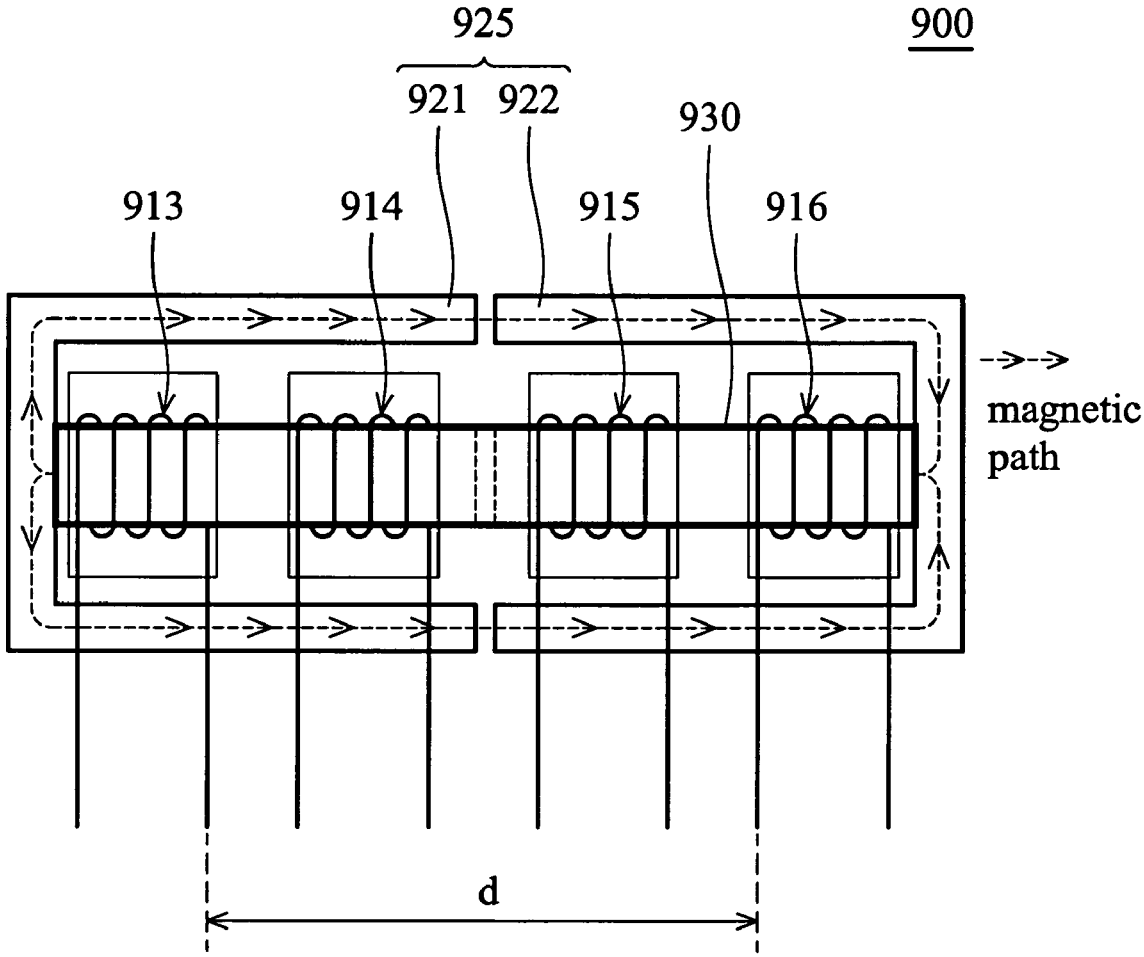
FIG. 9 depicts an embodiment of a transformer applied in the multi-lamp drivers of FIGS. 4, 5, 7, and 8.

FIG. 9 depicts a transformer applied in the drivers of FIGS. 4, 5, 7, and 8. A transformer 900 comprises a winding rack 930, a magnetic core 925, a first primary winding set 913, a second primary winding set 916, a first secondary winding set 914, and a second secondary winding set 915. The magnetic core 925 is composed by a first portion 921 (shape "E" given as an example) and a second portion 922 (shape "E" given as an example). The center of the first or second portion of the magnetic core 925*s* inserted into the winding rack 930. The first primary winding set 913 and the second primary winding set 916 respectively are wound around the winding rack 930, and the first primary winding set 913 is disposed away from the second primary winding set 916 at a predetermined distance d. The first secondary winding set 914 is wound around the winding rack 930, and it is disposed between the first primary winding set 913 and the second primary winding set 916 and closer to the first primary winding set 913. The second secondary winding set 915 is wound around the winding rack 930, and it is disposed between the first primary winding set 913 and the second primary winding set 916 and closer to second primary winding set 916. The first primary winding set 913 and the second primary winding set 916 have the same number of windings, and the first secondary winding set 914 and the second secondary winding set 915 have the same number of windings. The first secondary winding set 914 and the second secondary winding set 915 thus have the same magnetic flux and the same magnetic flux direction (referring to arrows in FIG. 9) according to electromagnetism, and currents flowing through the lamps coupled to the two secondary winding sets can be automatically balanced.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multi-lamp driver for driving a first lamp and a second lamp, comprising:

a driving circuit providing a first voltage signal and a second voltage signal; and a transformer comprising:

a winding rack;

a magnetic core, wherein one portion of the magnetic core is inserted into the winding rack;

a first primary winding set wound around the winding rack and coupled to the first voltage signal;

a second primary winding set wound around the winding rack, disposed away from the first primary winding set at a predetermined distance d, and coupled to the second voltage signal, wherein the first and second voltage signals are substantially equal;

a first secondary winding set wound around the winding rack and disposed between the first primary winding set and the second primary winding set and close to the first primary winding set, wherein the first secondary winding set induces a third voltage signal to drive the first lamp; and a second secondary winding set wound around the winding rack and disposed between the first primary winding set and the second primary winding set and close to second primary winding set, wherein the second secondary winding set induces a fourth voltage signal to drive the second lamp;

wherein the first primary winding set and the second primary winding set have substantially the same number of windings, and the first secondary winding set and the second secondary winding set have substantially the same number of windings.

2. The multi-lamp driver as claimed in claim 1, wherein the first and second lamps are discharging lamps.

3. The multi-lamp driver as claimed in claim 2, wherein the first and second lamps are cold cathode fluorescent lamps.

4. The multi-lamp driver as claimed in claim 1, wherein the magnetic core is composed of a first portion and a second portion, and the first portion and the second portion is formed as the shapes of one of the symbol sets, "EE", "UU", "UI", "EI", "UT", "⊟I", "⊟I", and "LL".

5. The multi-lamp driver as claimed in claim 1, wherein the first primary winding set and the second primary winding set are composed of at least one winding.

6. The multi-lamp driver as claimed in claim 1, wherein the first and second lamps are respectively coupled to the terminals of the first secondary winding set and the second secondary winding set which have the same polarity.

7. A transformer for a multi-lamp driver, comprising:

a winding rack;

a magnetic core, wherein one portion of the magnetic core is inserted into the winding rack;

a first primary winding set wound around the winding rack;

a second primary winding set wound around the winding rack and disposed away from the first primary winding set at a predetermined distance d;

a first secondary winding set wound around the winding rack and disposed between the first primary winding set and the second primary winding set and close to the first primary winding set; and a second secondary winding set wound around the winding rack and deposed between the first primary winding set and the second primary winding set and close to second primary winding set;

wherein the first primary winding set and the second primary winding set have the same number of windings, and the first secondary winding set and the second secondary winding set have the same number of windings.

8. The transformer as claimed in claim 7, wherein the magnetic core is composed of a first portion and a second portion, and the first portion and the second portion is formed as the shapes of one of symbol sets, "EE", "UU", "UI", "EI", "UT", "⊟I", "⊟I", and "LL".

* * * * *